US008757792B2

(12) United States Patent
Takano

(10) Patent No.: US 8,757,792 B2
(45) Date of Patent: Jun. 24, 2014

(54) IMAGE FORMING APPARATUS CAPABLE OF FORMING IMAGES ON BOTH SIDES OF RECORDING MEDIA

(75) Inventor: Kuniyori Takano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 141 days.

(21) Appl. No.: 13/456,344

(22) Filed: Apr. 26, 2012

(65) Prior Publication Data

US 2012/0300004 A1 Nov. 29, 2012

(30) Foreign Application Priority Data

May 25, 2011 (JP) ..... 2011-117348

(51) Int. Cl.
*B41J 2/01* (2006.01)

(52) U.S. Cl.
USPC ..... 347/104; 347/101

(58) Field of Classification Search
USPC ..... 347/101, 104, 103
See application file for complete search history.

(56) References Cited

U.S. PATENT DOCUMENTS 5,752,135 A * 5/1998 Coffey et al. ..... 399/115
6,499,841 B1 * 12/2002 Uchida et al. ..... 347/104
2005/0002689 A1 * 1/2005 Jeong et al. ..... 399/111
2005/0019067 A1 * 1/2005 Kang et al. ..... 399/306
2008/0050135 A1 2/2008 Kawabata
2012/0062648 A1 3/2012 Tanaka et al.

FOREIGN PATENT DOCUMENTS

JP 2000-242063 9/2000
JP 2005-195813 7/2005
JP 2005-242213 9/2005

OTHER PUBLICATIONS

U.S. Appl. No. 13/286,417, filed Nov. 1, 2011.
U.S. Appl. No. 13/286,426, filed Nov. 1, 2011.
U.S. Appl. No. 13/312,066, filed Dec. 6, 2011.

* cited by examiner

*Primary Examiner* — Manish S Shah
*Assistant Examiner* — Yaovi Ameh
(74) *Attorney, Agent, or Firm* — Cooper & Dunham LLP

(57) ABSTRACT

An image forming apparatus includes a body, a conveyance belt, an image forming device, a refeeding unit, a reverse passage, a charging unit, an openable cover, and a unit-interlocked moving device. The charging unit forms part of the reverse passage and includes a charger between an inner side of the reverse passage and one of rotation members. The cover is pivotable between a closed position to cover an internal area including at least the charger and the reverse passage and an open position to open the internal area to an outside of the body. With a pivoting movement of the cover from the closed position to the open position, the moving device moves the charging unit toward an outside of the reverse passage to a removable position at which the charging unit is removable from the body with the cover placed at the open position.

5 Claims, 11 Drawing Sheets

IMAGE FORMING APPARATUS CAPABLE OF FORMING IMAGES ON BOTH SIDES OF RECORDING MEDIA

CROSS-REFERENCE TO RELATED APPLICATION

This patent application is based on and claims priority pursuant to 35 U.S.C. §119 to Japanese Patent Application No. 2011-117348, filed on May 25, 2011, in the Japan Patent Office, the entire disclosure of which is hereby incorporated by reference herein.

BACKGROUND

1. Technical Field

This disclosure relates to an image forming apparatus capable of forming images on both faces of a sheet of recording media (hereinafter, simply referred to as "sheet"), and more specifically to an image forming apparatus capable of forming images on both sides of a sheet with an image forming device and a conveyance belt disposed opposing the image forming device.

2. Description of the Related Art

Image forming apparatuses are used as printers, facsimile machines, copiers, plotters, or multi-functional devices having two or more of the foregoing capabilities. Electrophotographic or other type of image forming apparatuses, may have a replaceable unit in which several internal components are integrated. For the replaceable unit, for example, a replacement method is known in which, by opening a cover covering the internal components, an operator can draw the replaceable unit for replacement. In another replacement method, the replaceable unit, e.g., a process cartridge or a charging unit moves with opening of the cover.

To provide an image forming apparatus capable of minimizing the setting space and production cost without reducing the inserting functionality of a detachable/attachable process cartridge and the ease of removal of jammed sheets, for example, JP-2005-242213-A proposes an image forming apparatus having an interlocking mechanism to move the process cartridge by press-contacting fixing members each other by a press contacting mechanism or releasing the press contact of the fixing members by a press-contact releasing mechanism with movement of the openable cover. For the image forming apparatus, opening the cover allows release of a fixing pressure, removal of the cartridge, and removal of jammed sheets in the apparatus. Specifically, the interlocking mechanism allows the process cartridge serving as the replaceable unit to be simply removed by movement of the openable cover. By opening the cover, a lever for moving the replaceable unit (process cartridge) to a designated position is separated from the replaceable unit, and the replaceable unit fixed at (urged with springs toward) an apparatus body can be drawn out. The replaceable unit has grips, and by opening the cover, an operator can obtain a large space enough to put his/her hands into the body, thus allowing the operator to grip the grips to draw the replaceable unit out.

JP-2005-195813-A proposes to modularize a charging device and other devices to replace components according to their product lives. In the art, by opening the cover, an operator can separately remove the modularized units for replacement.

In conventional arts like those described in JP-2005-242213-A and JP-2005-195813-A, when the cover is open, there is a large space enough for replacement work, thus allowing an operator to push his/her hands into the body to drawn out the replaceable unit.

Meanwhile, to allow operator's front operation with minimum increase in the apparatus size and the number of components, the present applicant proposes an inkjet-type image forming apparatus to eject ink in a substantially horizontal direction while conveying a recording sheet upward in a substantially vertical direction. In such a configuration, for example, in a case where a charging roller is integrated with other components as a single replaceable unit, there may be little space enough for an operator to put his/her hands into the body to draw the replaceable charging unit out from the body when an openable cover is opened. Accordingly, securing a large space for replacement work in such a configuration will increase the apparatus size, thus resulting in increased cost.

BRIEF SUMMARY

In an aspect of this disclosure, there is provided an image forming apparatus including a body, a conveyance belt, an image forming device, a refeeding unit, a reverse passage, a charging unit, an openable cover, and a unit-interlocked moving device. The conveyance belt is looped around at least two rotation members for circulation to convey a sheet of recording media. The image forming device is disposed opposing the conveyance belt to form images on the sheet at a first side of the conveyance belt opposing the image forming device. The refeeding unit is arranged to switch back the sheet having an image formed on a first face of the sheet and refeed and guide the sheet to the surface of the conveyance belt at a second side of the conveyance belt not opposing the image forming device. The reverse passage is arranged to, after the sheet refed from the refeeding unit passes the surface of the conveyance belt at the second side, guide the sheet again to the surface of the conveyance belt at the first side of the conveyance belt opposing the image forming device while turning around the sheet and bypassing an outer circumferential part of the conveyance belt looped around the at least two rotation members. The charging unit forms part of the reverse passage and includes a charger to charge the conveyance belt. The charger is disposed between an inner side of the reverse passage and one of the at least two rotation members upstream in a direction in which the sheet is conveyed by the surface of the conveyance belt at the first side of the conveyance belt. The openable cover is pivotable between a closed position to cover an internal area of the body including at least the charger and the reverse passage and an open position to open the internal area to an outside of the body. With a pivoting movement of the openable cover from the closed position to the open position, the unit-interlocked moving device moves the charging unit toward an outside of the reverse passage to a removable position at which the charging unit is removable from the body with the openable cover placed at the open position.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
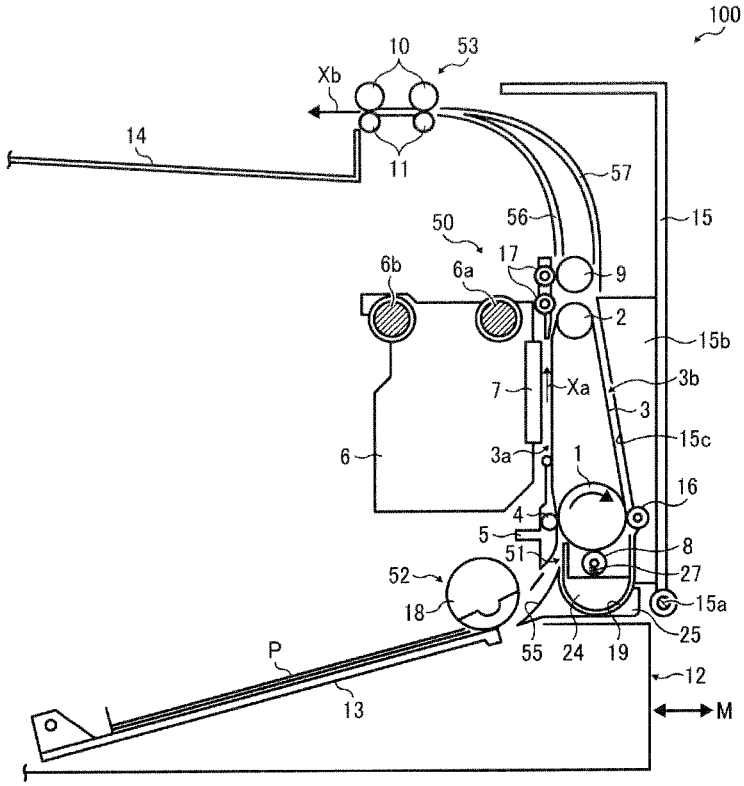
FIG. 1 is a schematic partial cross-sectional front view of a configuration of an inkjet recording apparatus according to a reference example of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, exemplary embodiments of the present disclosure are described below. In the following exemplary embodiments, the same reference characters are allocated to elements (members or components) having the same function and shape and redundant descriptions thereof are omitted below. For sake of simplicity and clearness, elements considered to require no specific descriptions may be omitted from drawings.

Figure 2:
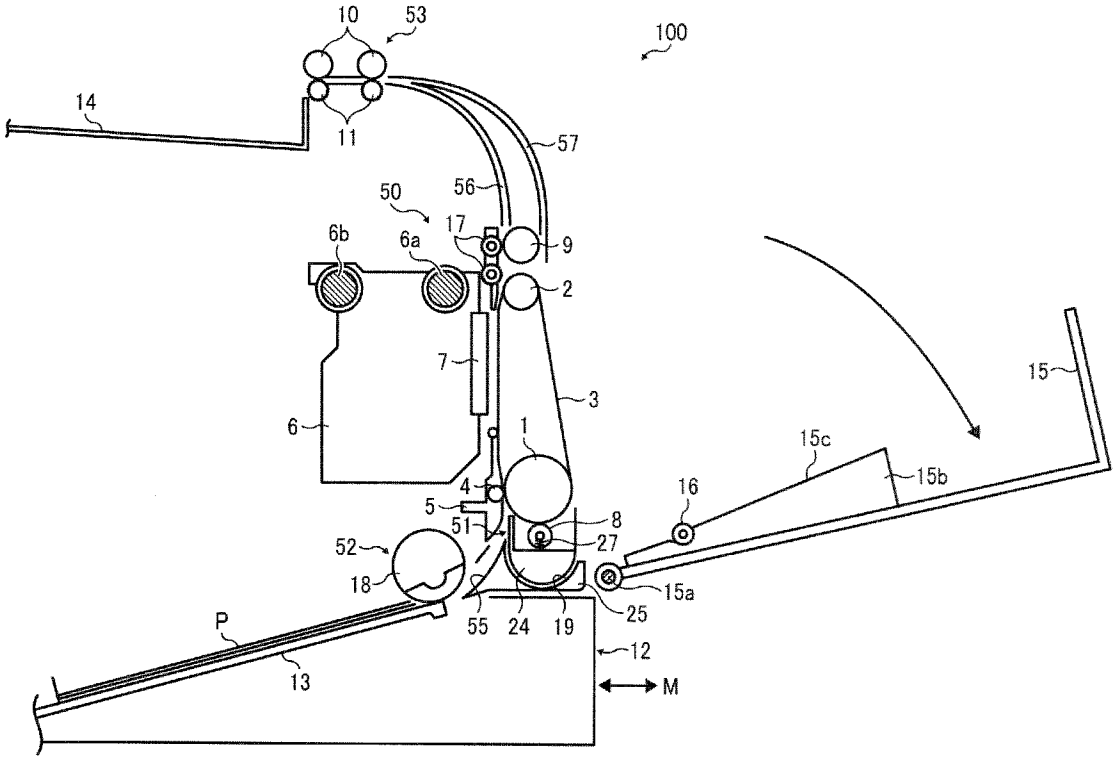
FIG. 2 is a schematic partial cross-sectional front view of the inkjet recording apparatus in a state where an openable cover is at an open position.

First, with reference to FIGS. 1 and 2, a configuration and operation of an inkjet recording apparatus serving as an image forming apparatus according to a reference example of this disclosure.

FIG. 1 is a schematic view of a configuration of the inkjet recording apparatus according to the reference example of this disclosure. FIG. 2 is a schematic view of the inkjet recording apparatus in a state where an openable cover is at an open position.

Below, the configuration of the inkjet recording apparatus according to the first exemplary embodiment is described with reference to FIG. 1.

An inkjet recording apparatus 100 illustrated in FIG. 1 is a serial-type inkjet recording apparatus. The inkjet recording apparatus 100 has an image forming section 50, a conveyance section 51, a sheet feed section 52, and an output-and-reversal section 53. The image forming section 50 includes, e.g., a recording head 7 serving as an image forming device to form images according to an inkjet method. The conveyance section 51 includes, e.g., a conveyance belt 3 to convey a sheet P (e.g., sheet of paper), and the sheet feed section 52 feeds the sheet P. The output-and-reversal section 53 outputs the sheet P having an image(s) formed (printed) thereon to the outside or refeeds the sheet P having an image formed on its single side (hereinafter may also referred to as "single-side printed sheet" or simply "the sheet") in a switchback manner.

A sheet feed path of the sheet P includes a sheet feed transport passage 55, a common transport passage 56, a duplex transport passage 57, and a reverse passage 19. The sheet feed transport passage 55 serves as a path to transport the sheet P fed from the sheet feed section 52 to the conveyance section 51. The common transport passage 56 is connected to and communicates with the sheet feed transport passage 55, and serves as a path to transport, to an area downstream from the image forming section 50, a single-side printed sheet P having an image formed on its front face (first face) or a duplex printed sheet P having images formed on both faces (i.e., in which an image has been formed on a back face (second face) of the single-sided printed sheet P having switched back and refed). The duplex transport passage 57 is connected to and communicates with the common transport passage 56, and serves as a duplex transport path (including a reverse path and a refeed path) to guide and transport the single-side printed sheet P having switched back and refed with two pairs of output rollers 10 and 11 serving as a refeeding unit, to a surface (hereinafter, opposite surface 3*b*) of the conveyance belt 3 at a side opposite a side opposing (facing) the recording head 7 of the image forming section 50. The reverse passage 19 serves as a reverse path to guide the single-side printed sheet P again to a surface (hereinafter "opposing surface 3*a*") of the conveyance belt 3 at the side opposing the recording head 7, after the single-side printed sheet P passes the opposite surface 3*b* of the conveyance belt 3 and is turned around while bypassing an outer circumferential part of the conveyance belt 3 wound around a conveyance roller 1. As illustrated in FIG. 1, the conveyance roller 1 is disposed at an area upstream from an area opposing the recording head 7 in a traveling direction of the conveyance belt 3. The reverse passage 19 serving as the reverse path (reverse route) bypasses the outer circumferential part of the conveyance belt 3 wound around the conveyance roller 1 to be formed in a substantially U shape.

Each of the sheet feed transport passage 55, the common transport passage 56, and the duplex transport passage 57 is formed with a pair of opposed guide members and so forth unless specifically described. As illustrated in FIG. 1, an openable cover 15 serving as an opening and closing member (cover member) and a guide rib 15*b* integrally molded with the openable cover 15 are disposed at a side of the opposite surface 3*b* of the conveyance belt 3 not opposing (facing) the recording head 7. When the openable cover 15 is at a closed position, the guide rib 15*b* opposes the opposite surface 3*b* to guide the single-side printed sheet P. The opposite surface 3*b* of the conveyance belt 3 and a guide face 15*c* of the guide rib 15*b* form an extension path of the duplex transport passage 57. The reverse passage 19 is formed with an inner guide member 24, an outer guide member 25, a guide face 26*a* of a unit housing 26 forming part of a charging unit 20 (see FIG. 3), and the guide face 15*c* of the guide rib 15*b*.

The image forming section 50 includes a carriage 6 movable for scanning. The carriage 6 is slidably supported on a main guide rod 6*a* and a sub guide rod 6*b* serving as guide members. The main guide rod 6*a* and the sub guide rod 6*b* are fixed in an apparatus body to extend across the body. The carriage 6 is connected to a main scanning motor via a timing belt and reciprocally moved for scanning in a main scanning direction with the main scanning motor.

On the carriage 6 is mounted the recording head 7 serving as a liquid ejection head to eject ink droplets of different colors, e.g., yellow (Y), cyan (C), magenta (M), and black (K). The recording head 7 is disposed opposing the conveyance belt 3 and serves as an image forming device or recording device to form images on a sheet P conveyed with the conveyance belt 3. The recording head 7 has multiple nozzles arranged in rows in a sub-scanning direction (sheet transport direction) Xa perpendicular to the main scanning direction and are mounted on the carriage 6 so as to eject ink droplets in a substantially horizontal direction. The recording head 7 has, for example, four nozzle rows to separately eject ink droplets of black (K), cyan (C), magenta (M), and yellow (Y).

On the carriage 6 are mounted head tanks to supply the respective color inks to the corresponding nozzle rows of the recording head 7. A supply pump unit supplies (replenishes) the respective color inks from recording-liquid cartridges to the head tanks via ink supply tubes dedicated for the respective color inks. The recording-liquid cartridges are removably mountable to a cartridge mount portion.

The sheet feed section 52 includes a sheet feed tray 12 to stack multiple sheets P thereon and a sheet feed roller 18 to feed the sheets P from the sheet feed tray 12, a separation pad to separate and feed the sheets 18 sheet by sheet in conjunction with the sheet feed roller 18, and a bottom plate 13 movable up and down with the sheets P stacked thereon. The sheet feed tray 12 is also referred to as a sheet feed cassette and removably insertable to the body along a direction indicated by an arrow M. The sheet feed roller 18 has, e.g., a half-moon shape as illustrated in FIG. 1. The sheet feed tray 12, the sheet feed roller 18, and the separation pad form a sheet feed unit.

The conveyance section 51 is arranged to transport a sheet P fed from the sheet feed section 52 in simplex printing or a single-side printed sheet P having reversed in duplex printing via the conveyance section 51 to a position opposing the recording head 7 of the image forming section 50. The conveyance section 51 includes the conveyance belt 3, the conveyance roller 1, a tension roller 2, a front end roller 4, a charging roller 8, a conveyance guide plate disposed at a back-face side of the opposing surface 3*a* of the conveyance belt 3, and a separation claw.

The conveyance belt 3 adheres the sheet P thereon by electrostatic force and conveys the sheet P to the position opposing the recording head 7. Thus, the conveyance belt 3 serves as a conveyance unit to intermittently convey the sheet P in the sheet transport direction Xa. The conveyance belt 3 is an endless belt looped around the conveyance roller 1 serving as a rotary driving member and the tension roller 2 serving as a rotary driven member so as to circulate in a belt traveling direction Xa (also referred to as sheet transport direction or sub-scanning direction).

The conveyance roller 1 is rotated with a driving mechanism including a driving unit, e.g., a sub scanning motor via a timing belt serving as a driving force transmission member. When the conveyance roller 1 is rotated with the sub scanning motor, the conveyance belt 3 circulates in the belt traveling direction Xa. As described above, in this exemplary embodiment, the conveyance belt 3 is described as an endless belt. It is to be noted that the conveyance belt may be a molded endless belt or an endless belt produced by connecting both ends of an open-ended belt.

The conveyance belt 3 has a single or multi layer structure. At least at a side (outer surface) contacting the sheet P and the charging roller 8, the conveyance belt 3 has an insulation layer of, for example, a resin, such as polyethylene terephthalate (PET), polyether imide (PEI), polyvinylidene fluoride (PVDF), polycarbonate (PC), ethylene tetrafluoroethylene (ETFE), or polytetrafluoroethylene (PTFE), or an elastomer not including conductivity control material to retain electric charges. In a case where a multi layer structure is employed, the conveyance belt 3 may have a conductive layer of the above-mentioned resin or elastomer containing carbon at a side not contacting the charging roller 8.

The front end roller 4 serves as a pressing member to press the conveyance belt 3 from an outer surface side (conveyance face side). The front end roller 4 is disposed adjacent to the recording head 7 and upstream from the recording head 7 in the belt traveling direction Xa of the conveyance belt 3 so as to press the conveyance roller 1 via the conveyance belt 3, thus causing the sheet P to closely contact the conveyance belt 3. The conveyance guide plate is disposed at a position between the conveyance roller 1 and the tension roller 2 and opposing the recording head 7 inside the loop of the conveyance belt 3, and serves as a belt guide member to guide the conveyance belt 3 from the inside of the loop of the conveyance belt 3. The separation claw is disposed downstream from the recording head 7 in the belt traveling direction Xa so as to press against the tension roller 2 via the conveyance belt 3, and serves as a separation member to separate the sheet P from the conveyance belt 3.

The charging roller 8 is disposed upstream from the conveyance roller 1 in the belt traveling direction Xa, and serves as a charger to charge the surface of the conveyance belt 3. Springs (compression springs) 27 are disposed at opposed ends of a shaft of the charging roller 8 to apply pressing force so that the charge roller 8 contacts the outer surface (insulation layer) of the conveyance belt 3 and rotates with the circulation of the conveyance belt 3. The charging roller 8 forms part of a charging unit 20 illustrated in FIG. 3.

A voltage application unit alternately applies plus outputs and minus outputs, i.e., positive and negative voltages to the charging roller 8 so that the conveyance belt 3 is charged with an alternating voltage pattern, that is, an alternating band pattern of positively-charged areas and negatively-charged areas in the sub-scanning direction Xa, i.e., the belt circulation direction. When the sheet P is fed onto the conveyance belt 3 alternately charged with positive and negative voltages, the sheet P is adhered to the conveyance belt 3 by electrostatic force and conveyed in the sub scanning direction Xa by the circulation of the conveyance belt 3.

By driving the recording head 7 in response to image signals under control of a controller while moving the carriage 6, ink droplets are ejected onto the sheet P, which is stopped below the recording head 7, to form one band of a desired image. Then, the sheet P is conveyed at a certain distance by the conveyance belt 3 to prepare for the next recording of another band of the image. When the controller receives a recording end signal or a signal indicating that the rear edge of the sheet P has exited from the recording area, the recording head 7 finishes the recording operation.

At a position downstream from the conveyance belt 3 in the conveyance section 51 in the sheet transport direction, paired rollers are disposed adjacent to the conveyance belt 3 and downstream from the recording head 7 in the sheet transport direction to transport the sheet P having separated from the conveyance belt 3 with the separation claw. The paired rollers include spurs 17 of, e.g., a star-shaped cross section and a second conveyance roller 9 opposing and contacting one of the spurs 17. The spurs 17 contact a face of the sheet P opposing the recording head 7 at positions downstream from the recording head 7. In a case where the sheet P is, for example, a plain sheet of paper, an overhead projector (OHP) sheet, a card, a postcard, an envelope, or any other cardboard, the spurs 17 simply assist to feed the sheet P and do not necessarily define a clearance between the face of the sheet P and the recording head 7 by sandwiching the sheet P between the second conveyance roller 9 and the spurs 17.

As the sheet output section to output the sheet P on which an image has been formed by the recording head 7, the image forming apparatus further includes the two pairs of output rollers 10 and 11 serving as both a sheet output unit and a refeeding unit to send, to the output-and-reversal section 53, the sheet P having fed with the second conveyance roller 9 and the spurs 17. The two pairs of output rollers 10 and 11 include spurs 11 of, e.g., a star-shaped cross section and output rollers 10 opposing and contacting the spurs 11. Downstream from the two pairs of output rollers 10 and 11 in the sheet transport direction, an output guide member is disposed to guide the sheet P sent from the two pairs of output rollers 10 and 11 and a sheet output tray 14 is disposed to stack the sheet P output thereon.

Next, a configuration of duplex printing is described below.

The output rollers 10 and the spurs 11 are driven with a driving unit so as to be rotatable both clockwise and counterclockwise directions, thus allowing switchback operation for switching the front and back ends of the single-side printed sheet P. In other words, the output rollers 10 and the spurs 11 serve as the refeeding unit to switch back the single-side printed sheet P having passed the opposing surface 3*a* of the conveyance belt 3 and feed the single-side printed sheet P toward the recording head 7 of the image forming section 50 again.

A branching claw serving as a branching member pivotable around a shaft to switch the sheet P back is disposed at a branching section of the output-and-reversal section 53 at which the common transport passage 56 branches from the duplex transport passage 57. As described above, the refeeding unit typically includes the two pairs of output rollers 10 and 11, the duplex transport passage 57, and the branching claw. The guide rib 15*b* of the openable cover 15 serving as a guide member to guide the single-side printed sheet P along the opposite surface 3*b* is disposed at a side proximal to the opposite surface 3*b* of the conveyance belt 3 not opposing (facing) the recording head 7.

Near an entrance of the reverse passage 19 and downstream from the guide rib 15*b*, a duplex pressing roller 16 serving as a pressing member and another separation claw serving as a separation member are disposed so as to press the conveyance roller 1 via the conveyance belt 3. The duplex pressing roller 16 is rotatably supported in the openable cover 15.

Below, operation of the inkjet recording apparatus 100 according to this exemplary embodiment is described with reference to FIG. 1.

First, simplex printing (on a first face of a sheet P) is described below.

When a power switch is turned on and an operator finishes inputs, such as the number of prints and scaling, with keys/buttons of an operation unit, the sheet feed section 52 receives control commands from a controller for controlling operations of the inkjet recording apparatus 100 and turns into an activation ready state in synchronization with the image forming section 50 and the conveyance section 51. The sheet feed roller 18 and the separation pad cooperate to separate and feed the topmost one of the sheets P on the bottom plate 13. Furthermore, the sheet P, while guided along the sheet feed transport passage 55, is sent to a nipping portion between the front end roller 4 and the conveyance belt 3.

At this time, the conveyance roller 1 is rotated by the sub-scanning motor, so that the conveyance belt 3 circulates in the sub-scanning direction (belt traveling direction) Xa. In addition, at this time, the charging roller 8 contacts the outer surface of the conveyance belt 3 and rotates with the circulation of the conveyance belt 3. Meanwhile, the voltage application unit applies alternating voltages to the charging roller 8, thus causing the charging roller 8 to be charged in an alternative band pattern in which positively and negatively charged areas are alternately repeated at a certain width. When the sheet P is fed onto the conveyance belt 3 alternately charged with positive and negative voltages, the sheet P is adhered to the opposing surface 3*a* of the conveyance belt 3 by electrostatic force and conveyed in the sub scanning direction Xa by the circulation of the conveyance belt 3. Then, the sheet P is temporarily stopped at a recording area of the recording head 7.

The carriage 6 is driven to move in the main scanning direction (between the front side and the back side in a direction perpendicular to a printed sheet surface of FIG. 1), and the recording head 7 is driven in response to image signals. Thus, ink droplets are ejected onto a first face of the sheet P stopped to form one band of a desired image. After the sheet P is conveyed with the conveyance belt 3 at a certain distance, another band of the image is formed. Then, the sheet P is conveyed by the conveyance belt 3 with the rotation of the conveyance roller 1. The sheet P having the image formed on the first face (also referred to as "single-side printed sheet P" or simply "sheet P") is separated from the conveyance belt 2 with the separation claw, and sent to the output-and-reversal section 53 by the spurs 17 and the second conveyance roller 9.

The sheet P, while being guided along the output guide member, is transported to the downstream side in the sheet conveyance direction Xa.

The sheet P is further transported to the downstream side in a sheet output direction Xb by, e.g., normal (forward) rotation of the two pairs of output rollers 10 and 11. When the controller receives a recording end signal or a signal indicating that the rear edge of the sheet P has exited from the recording area, the recording head 7 finishes the recording operation and the sheet P is output and stacked on the sheet output tray 14.

Next, duplex printing operation is described below.

After simplex printing is performed in the above-described manner, when the front end of the single-side printed sheet P is guided to nipping portions of the two pairs of output rollers 10 and 11 and the rear end of the single-side printed sheet P passes the branching section of the output-and-reversal section 53, a sensor detects that the rear end of the single-side printed sheet P has passed the branching section. By rotating the output rollers 10 and the spurs 11 in reverse, switchback operation is performed to switch the front and back ends of the single-side printed sheet P. At this time, the sheet transport path of the single-side printed sheet P is switched to the duplex transport passage 57 by the branching claw of the branching section. When the sensor detects the front end of the single-side printed sheet P having switched back (i.e., the rear end of the sheet P before switched back), the front end of the single-side printed sheet P is transported toward a lower portion of the duplex transport passage 57 in FIG. 1.

After the single-side printed sheet P passes the duplex transport passage 57, the sheet P is conveyed with circulation of the conveyance belt 3 with the sheet P adhered to the opposite surface 3*b* of the conveyance belt 3 not opposing the recording head 7. Then, while being pressed by the conveyance roller 1 via the conveyance belt 3, the single-side printed sheet P is fed by the duplex pressing roller 16 and separated from the conveyance belt 3 by the separation claw. The single-side printed sheet P is guided along the reverse passage 19, passes the nipping portion between the front end roller 4 and the conveyance roller 1, and is conveyed to the area opposing the recording head 7 with circulation of the conveyance belt 3. At this time, in the same manner as the above-described manner, the single-side printed sheet P is adhered to the opposing surface 3*a* of the conveyance belt 3 and conveyed to the recording area of the recording head 7. The charging roller 8 is disposed at an inner face side of the reverse passage 19, thus allowing the single-side printed sheet P to be consistently adhered to a freshly charged state of the conveyance belt 3. Here, descriptions of subsequent operations are omitted for simplicity, because one of ordinal skill in the art would be able to understand and execute the subsequent operations based on the above description of simplex printing.

The inkjet recording apparatus 100 has the openable cover 15 serving as the opening and closing body/member to be openable to remove a sheet P jammed in the duplex transport passage 57 and the reverse passage 19 serving as the duplex transport path. The openable cover 15 is pivotable around a support shaft 15*a* serving as a pivot axis for opening and closing. For example, the openable cover 15 is pivotable between a closed position illustrated in FIG. 1 in which the openable cover 15 is closed relative to the body and an open position illustrated in FIG. 2 in which the openable cover 15 is open relative to the body. A portion of the openable cover 15 serves as a part of an inner guide of the reverse passage 19, thus allowing removal of the sheet P jammed at the reverse passage 19.

According to the reference example illustrated in FIGS. 1 and 2, in the inkjet recording apparatus 100 serving as an image forming apparatus capable of performing duplex printing, the refeeding unit (the two pairs of output rollers 10 and 11, the duplex transport passage 57, and the branching claw) is arranged to refeed and guide the single-side printed sheet P to the opposite surface 3*b* of the conveyance belt 3 not opposing the recording head 7. Such a configuration can minimize the size and cost of the image forming apparatus.

Here, possible challenges in replacing the charging roller 8 with the openable cover 15 being open are described below.

In the inkjet recording apparatus 100 illustrated in FIGS. 1 and 2, a front face of the body is placed at the right side of FIGS. 1 and 2. The inkjet recording apparatus 100 has a configuration that allows an operator to perform front operation while minimizing the size of the body (or machine).

To minimize the machine size and the number of components while allowing front operation, as illustrated in FIGS. 1 and 2, the inkjet recording apparatus 100 according to this reference example has the sheet transport path to form an image on a sheet by ejecting ink droplets in a substantially horizontal direction while moving the carriage 6 mounting the recording head 7 in the main scanning direction. Such a configuration allows an operator to access to the sheet feed tray 12 from the front face of the apparatus, and the sheet P to be output with a printed face side facing down (face-down sheet output).

In addition, likewise, to allow an operator to deal with a sheet jam from the front side of the body while minimizing the machine size and the number of components, the duplex transport passage (refeeding passage) 57 to turn around a single-side printed sheet to form an image on its second (back) face has a configuration in which the sheet P separated from the conveyance belt 3 is switched back at the output-and-reversal section 53 and conveyed with the sheet P adhered to the opposite surface 3*b* of the conveyance belt 3 not opposing the carriage 6.

The charging roller 8 forming part of a charging unit might be disposed at an upper side of the conveyance belt 3 or in the refeed path. However, because high voltage is applied to the charging roller 8, in this exemplary embodiment, the charging roller 8 is disposed near a printing section (image forming section) and below and adjacent to the conveyance belt 3 in consideration of the prevention of operator's unintentional contact or the charging efficiency of print face. Specifically, the arrangement of the charging roller 8 is employed as the following reasons. For example, if the charging roller 8 is disposed at an upper side of the conveyance belt 3, an operator might unintentionally contact the charging roller 8 when the conveyance belt 3 is open. Alternatively, because the second conveyance roller 9 is also disposed at the upper side of the conveyance belt 3, placing the charging roller 8 at the upper side would force layout change, resulting in an increased machine size. Alternatively, if the charging roller 8 is disposed in the refeed path, the sheet P is transported between the conveyance belt 3 and the charging roller 8. As a result, the attachment force of the sheet P may decrease at the opposing surface 3*a*, thus reducing the charging efficiency.

In addition, as described above, when the openable cover 15 is opened to replace the charging roller 8, there is no space enough for an operator to put his/her hand into the interior of the body to draw the charging unit 20 out. One reason is that the conveyance roller 1 is disposed above the charging unit 20, and the reverse passage 19 for duplex printing and the sheet feed tray 12 are disposed below the charging unit 20.

In addition, to obtain such a space would increase the machine size (and cost). Enlarging the reverse passage 19 can facilitate the replacement work of the charging unit 20 but affect the position of the sheet feed tray 12, thus increasing the machine size. In addition, in this exemplary embodiment, to enhance ease of operation, the sheet feed tray 12 can be drawn from the body with the openable cover 15 placed at the open position. As a result, the support shaft 15*a* of the openable cover 15 is placed between the sheet feed tray 12 and the charging unit 20 to be replaced. Accordingly, disposing the support shaft 15*a* at a lower position would result in an increased machine size. Furthermore, since ink may contaminate the charging roller 8, maintenance operation need be performed on the charging roller 8. To cope with such challenges, an exemplary embodiment of this disclosure has the following configuration.

First Exemplary Embodiment

An inkjet recording apparatus according to a first exemplary embodiment is described below with reference to FIGS. 3 to 6.

An openable cover and a charging unit in the first exemplary embodiment are described with reference to FIG. 3.

Figure 3:
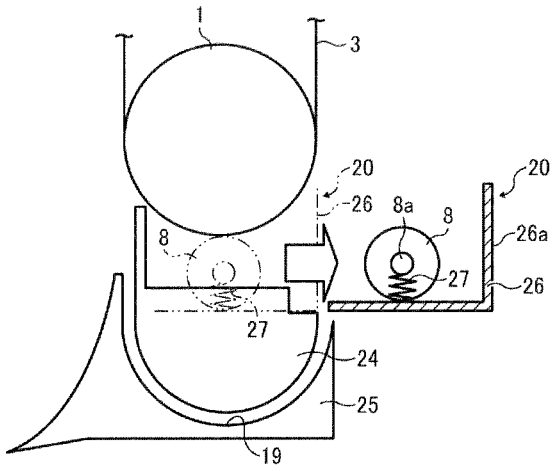
FIG. 3 is a schematic partial cross-sectional front view of a configuration of a charging unit and a surrounding area of a reverse passage in a first exemplary embodiment.

FIG. 3 is a schematic view of a configuration of the charging unit and a surrounding area of a reverse passage in the first exemplary embodiment. The inkjet recording apparatus according to the first exemplary embodiment differs from the inkjet recording apparatus 100 according to the reference example illustrated in FIGS. 1 and 2 mainly in that the former has a charging unit 20 including a charging roller 8 and springs 27 illustrated in FIG. 3, and a slider crank mechanism illustrated in FIGS. 4A, 4B, 5A, and 5B serving as a newly-added unit-interlocked moving device. Except for the differences, the inkjet recording apparatus according to the first exemplary embodiment is substantially the same as the inkjet recording apparatus 100 according to the reference example.

The openable cover 15 is disposed at an outer side of a reverse passage (bypass passage) 19 and a duplex transport passage (refeed passage) 57 so as to pivot around a support shaft 15*a*. For example, the openable cover 15 is pivotable between a closed position illustrated in FIG. 4A and an open position illustrated in FIG. 4B. The openable cover 15 covers an internal area of the body including at least a charging roller 8, the reverse passage 19, and the duplex transport passage 57 at the closed position and opens the internal area of the body to the outside at the open position. When the openable cover 15 is placed at the open position, an operator can remove a jammed sheet P from the duplex transport passage 57 or the reverse passage 19. When the openable cover 15 is open, the charging roller 8 still forms part of the charging unit 20 illustrated in FIG. 3 that is replaceable and removably mountable in the body. The charging roller 8 can be replaced from a side of the body at which the openable cover 15 is mounted. A replacement method and a detailed configuration of the charging unit 20 are described below. The support shaft 15*a* is disposed higher than and adjacent to the sheet feed tray 12 so that the sheet feed tray 12 can be inserted to and withdrawn from the body with the openable cover 15 open. The support shaft 15*a* is pivotably supported in the body.

Next, a configuration of the charging unit for mounting, removing, and replacing the charging roller and a replacement method of the charging unit are described with reference to FIGS. 1 to 3.

The charging unit 20 has the charging roller 8, a unit housing 26 having, e.g., support portions to support bearings of the charging roller 8, and the springs (compression springs) 27 serving as urging members to urge the charging roller 8 in such a direction that the charging roller 8 contacts the conveyance roller 1 with pressure. The springs 27 urge the charging roller 8 toward the conveyance roller 1 via the bearings that rotatably support opposed end portions of a shaft 8*a* of the charging roller 8.

The unit housing 26 has grips for insertion and removal and a guide face 26*a* at which one end of each spring 27 is attached and that forms part of the inner guide of the reverse passage 19. When the charging unit 20 is mounted in the body, the charging unit 20 is placed at a mount position indicated by broken lines in FIG. 3. By contrast, in replacing the charging roller 8, the entire charging unit 20 is slid to a removable position so that an operator can replace the charging roller 8.

The charging unit 20 has the unit housing 26 having the guide face 26*a*, and as a result, serves as a part of the inner guide of the reverse passage 19. The openable cover 15 has the guide face 15*c* serving as a part of an outer guide of the reverse passage 19. When the openable cover 15 is opened, the charging unit 20 becomes replaceable. The charging unit 20 has a separating mechanism to separate the sheet P having passing the duplex transport passage 57 from the conveyance belt 3 just before the sheet P arrives at the charging roller 8. The charging unit 20 may have a discharging sheet and/or a cleaning device.

Next, the slider crank mechanism serving as the unit-interlocked moving device to replace the charging unit is described with reference to FIGS. 4 to 6.

Figure 4B:
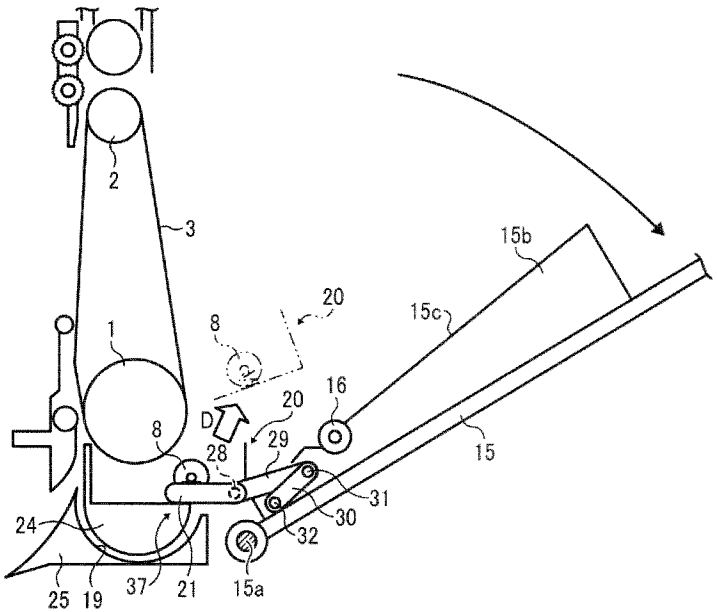
FIG. 4B is a schematic partial cross-sectional front view of an operation state of the charging unit and the slider crank mechanism in a state where the openable cover is at the open position.
Figure 4A:
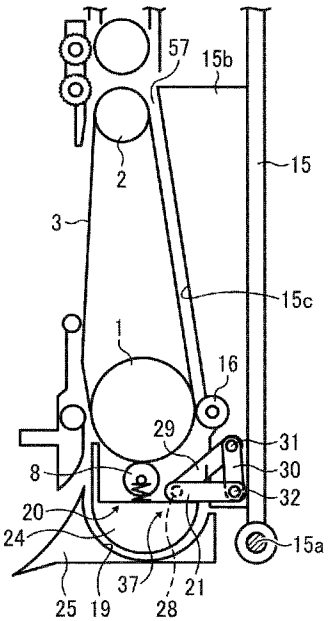
FIG. 4A is a schematic partial cross-sectional front view of an operation state of the charging unit and a slider crank mechanism in a state where the openable cover is at a closed position.
Figure 5B:
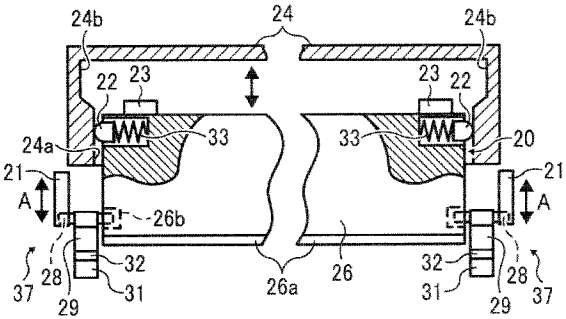
FIG. 5B is a schematic partial cross-sectional plan view of an operation state of the charging unit and the slider crank mechanism in a state where the openable cover is at the open position.
Figure 5A:
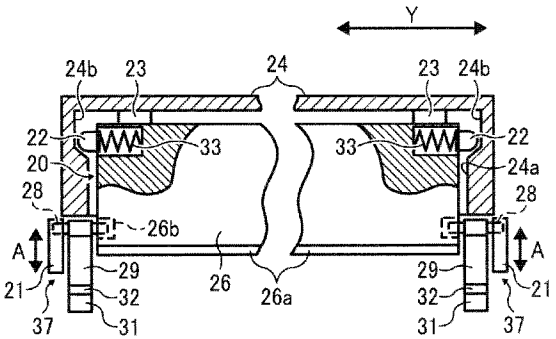
FIG. 5A is a schematic partial cross-sectional plan view of an operation state of the charging unit and the slider crank mechanism in a state where the openable cover is at the closed position.

FIG. 4A is a schematic view of the charging unit and the slider crank mechanism in a state where the openable cover is at a closed position. FIG. 4B is a schematic view of the charging unit and the slider crank mechanism in a state where the openable cover is at an open position. FIG. 5A is a schematic view of an operation state of the charging unit and the slider crank mechanism in a state where the openable cover is the closed position. FIG. 5B is a schematic view of an operation state of the charging unit and the slider crank mechanism in a state where the openable cover is at the open position. FIG. 6 is a partially exploded perspective view of the charging unit and the slider crank mechanism.

Figure 6:
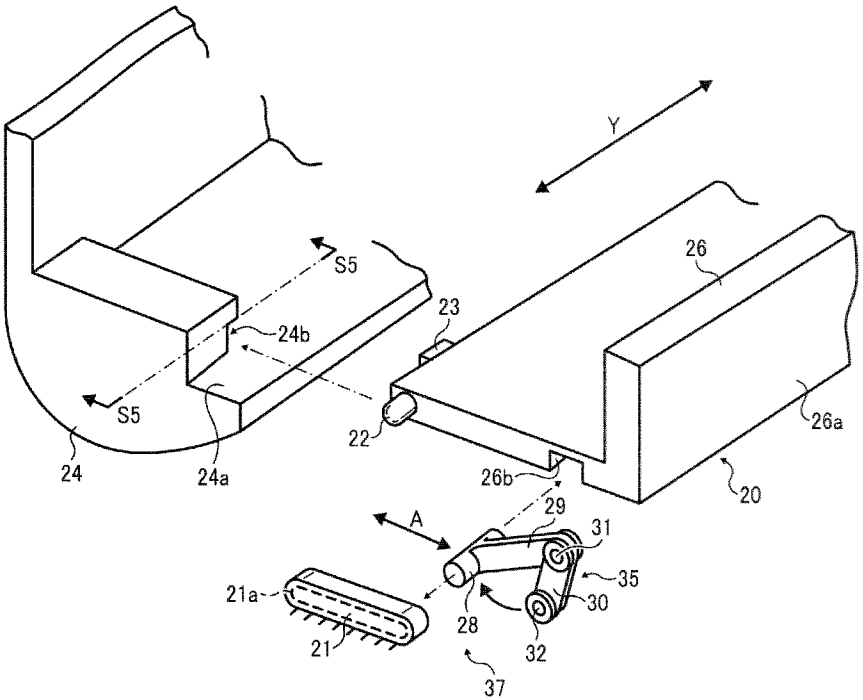
FIG. 6 is a partially exploded perspective view of the charging unit and the slider crank mechanism in the first exemplary embodiment.

In FIGS. 5A, 5B, and 6, for example, the conveyance belt, the charging roller, and the openable cover are omitted for clarification. FIGS. 5A and 5B show a cross sectional plane of the inner guide member 24 cut along a line S5-S5 in FIG. 6.

As illustrated in FIGS. 4A to 6, the slider crank mechanism 37 slides the charging unit 20 toward the outside of the reverse passage 19 with a pivoting opening operation of the openable cover 15 from a closed position to an open position. Thus, the slider crank mechanism 37 serves as a unit-interlocked moving device to move the charging unit 20 to a removable position at which the charging unit 20 is removable from the body when the openable cover 15 is placed at the open position. The slider crank mechanism 37 is disposed at each end of the reverse passage 19 in a sheet width direction indicated by an arrow Y in FIG. 6, and has a slider guide member 21 and a link unit 35. The slider guide member 21 is fixed at the body at a position adjacent to each end of the reverse passage 19 in the sheet width direction Y. The slider guide member 21 has an elongated bottomed groove 21*a* which a slider 28 of the link unit 35 slidably engages. The charging unit 20 is slidable along a length of the bottomed groove 21*a* in a direction indicated by an arrow A in FIG. 6.

As illustrated in FIG. 6, the link unit 35 has a fixed link 30, a link 29, and the slider 28. The fixed link 30 is fixed at an outer wall face of the guide rib 15*b* at each end of the openable cover 15 in the sheet width direction Y. A first end of the link 29 is pivotably connected to an end of the fixed link 30 with a stepped pin 31. The slider 28 has, e.g., a cylindrical shape and is integrally molded with a second end of the link 29 opposite the first end. The fixed link 30 serves as a crank of the slider crank mechanism. The stepped pin 31 and a stepped pin 32 are fixed at an outer wall face of the guide rib 15*b* at each end of the openable cover 15 in the sheet width direction Y. It is to be noted that, instead of the stepped pins 31 and 32, for example, stepped screws may be employed.

In FIG. 6, at a right front side of each end of the unit housing 26 of the charging unit 20 in the sheet width direction Y, a slider engagement portion 26*b* is formed as a rectangular parallelepiped opening to selectively engage the slider 28 of the link unit 35. At a left rear side of each end of the unit housing 26 in the sheet width direction Y, a boss 22 is urged with a spring (compression spring) 33 so as to be projectable and retractable relative to a wall face of a bottom portion of the unit housing 26. As illustrated in, e.g., FIGS. 5A and 5B, the unit housing 26 has projections 23 at each end of a wall face (at an upper side in FIGS. 5A and 5B) of the bottom portion of the unit housing 26 in the sheet width direction Y. As illustrated in FIG. 6, the inner guide member 24 has a first boss guide face 24*a* and a second boss guide face 24*b* at each end in the sheet width direction Y. The first boss guide face 24*a* engages the boss 22 of the unit housing 26 to slidably guide the unit housing 26. The second boss guide face 24*b* is connected to the first boss guide face 24*a* via a slant portion in a plan view. Thus, a distance between the second boss guide faces 24*b* is set to be longer than a distance between the first boss guide faces 24*a*.

Next, operation of the slider crank mechanism 37 with opening and closing of the openable cover 15 is described below.

In FIG. 4A, when the openable cover 15 is placed at the closed position, a first end of the slider 28 molded with the second end of the link 29 is placed at a first end (left end in FIG. 4A) of the bottomed groove 21*a* of the slider guide member 21 proximal to the inner guide member 24. Simultaneously, a second end of the slider 28 opposite the first end engages the slider engagement portion 26*b* of the unit housing 26. As a result, the charging unit 20 is pressed by the link unit 35 toward the mount position to take the mount position. Thus, when the openable cover 15 is placed at the closed position, the charging unit 20 cannot be slid for replacement or other operation.

As illustrated in FIG. 5A, when the openable cover 15 is placed at the closed position, the projections 23 projecting from the wall face (upper wall face in FIG. 5A) of the unit housing 26 contact an inner wall face of the inner guide member 24. Simultaneously, the bosses 22 urged with the springs 33 in the unit housing 26 are pressed against the second boss guide faces 24*b* at the opposed ends of the inner guide member 24, thus assisting to prevent the charging unit 20 from sliding toward the openable cover 15. When the openable cover 15 is placed at the closed position, finally, the slider crank mechanism 37 serves as a pressing unit to prevent the charging unit 20 from moving to the removable position.

In FIG. 4B, with the pivoting opening operation of the openable cover 15 toward the open position, the slider 28 molded with the second end of the link 29 slides to a second end (right end in FIG. 4B) of the bottomed groove 21*a* of the slider guide member 21 proximal to the openable cover 15. Simultaneously, through engagement of the second end of the slider 28 with the slider engagement portion 26*b* of the unit housing 26, the charging unit 20 slides on a bottom wall face of the inner guide member 24 to the right side of FIG. 4B (toward the openable cover 15). As a result, the charging unit 20 takes the removable position (see FIGS. 3 and 5B) at which the charging unit 20 can be drawn for replacement in a direction indicated by an arrow D in FIG. 4B.

As illustrated in FIG. 5B, when the openable cover 15 is at the open position, the unit housing 26 slides to the lower side in FIG. 5B (toward the openable cover 15). As a result, the projections 23 of the unit housing 26 separate from the inner wall surface of the inner guide member 24, and the bosses 22 of the unit housing 26 press the respective first boss guide faces 24*a* at both sides of the unit housing 26. In addition, the charging unit 20 is placed on the second ends of the respective sliders 28 via the slider engagement portions 26*b*. Thus, as illustrated in FIG. 4B, the charging unit 20 becomes a replaceable state in which the charging unit 20 can be drawn in the direction indicated by the arrow D in FIG. 4B. When the charging unit 20 having finished servicing/maintenance or cleaning or a new charging unit 20 is installed/set to the body, the above-described operations are performed in the opposite order, that is, from the removable position illustrated in FIG. 4B to the mount position of FIG. 4A. Here, descriptions thereof are omitted for simplicity, because one of ordinal skill in the art would be able to understand and execute the operations in the opposite order based on the above description.

As described above, the inkjet recording apparatus according to this exemplary embodiment has the slider crank mechanism 37 serving as the unit-interlocked moving device. The slider crank mechanism 37 slides the charging unit 20 toward the outside of the reverse passage 19 with a pivoting opening operation of the openable cover 15 from the closed position to the open position. When the openable cover 15 is placed at the open position, the slider crank mechanism 37 moves the charging unit 20 to the removable position at which the charging unit 20 is removable from the body. Thus, even if there is little enough space to open the openable cover 15 to draw the charging unit (replaceable unit) 20 out, with minimum increase in machine size and cost, the inkjet recording apparatus allows removal of the charging unit 20 from the body to replace or maintain/clean the charging roller 8 or other components.

Variation 1 of First Exemplary Embodiment

Next, a charging unit and a slider crank mechanism in an inkjet recording apparatus according to a variation 1 of the first exemplary embodiment are described with reference to FIGS. 7A to 9.

Figure 7B:
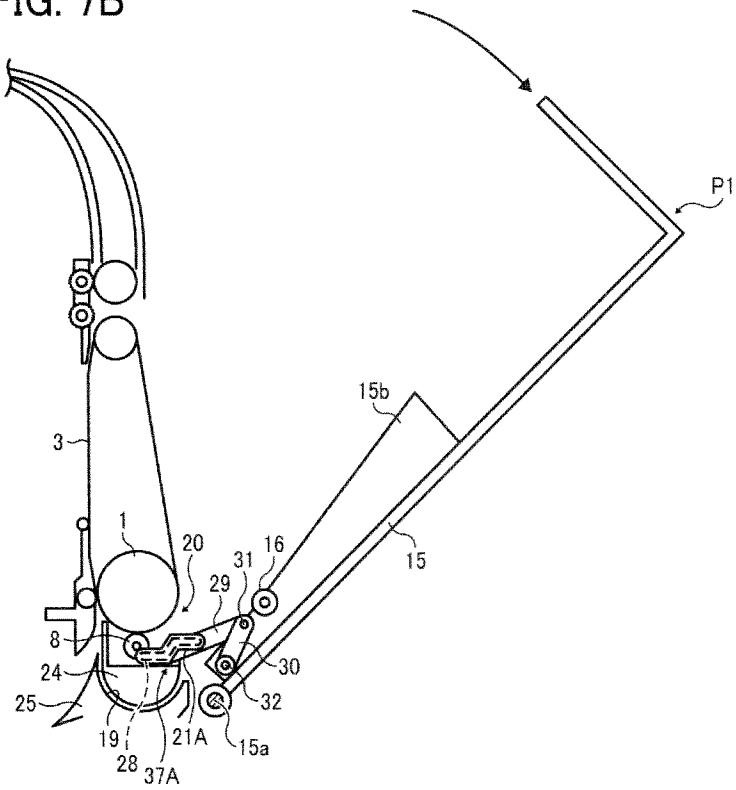
FIG. 7B is a schematic partial cross-sectional front view of an operation state of the charging unit and the slider crank mechanism in the variation 1 in a state where the openable cover is at a first open position.
Figure 7A:
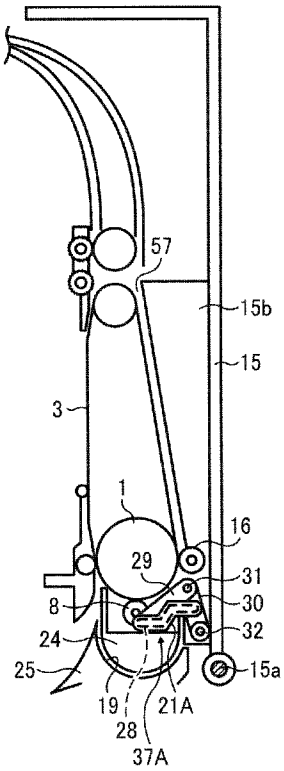
FIG. 7A is a schematic partial cross-sectional front view of an operation state of a charging unit and a slider crank mechanism in a variation 1 of the first exemplary embodiment in a state where an openable cover is at a closed position.
Figure 7C:
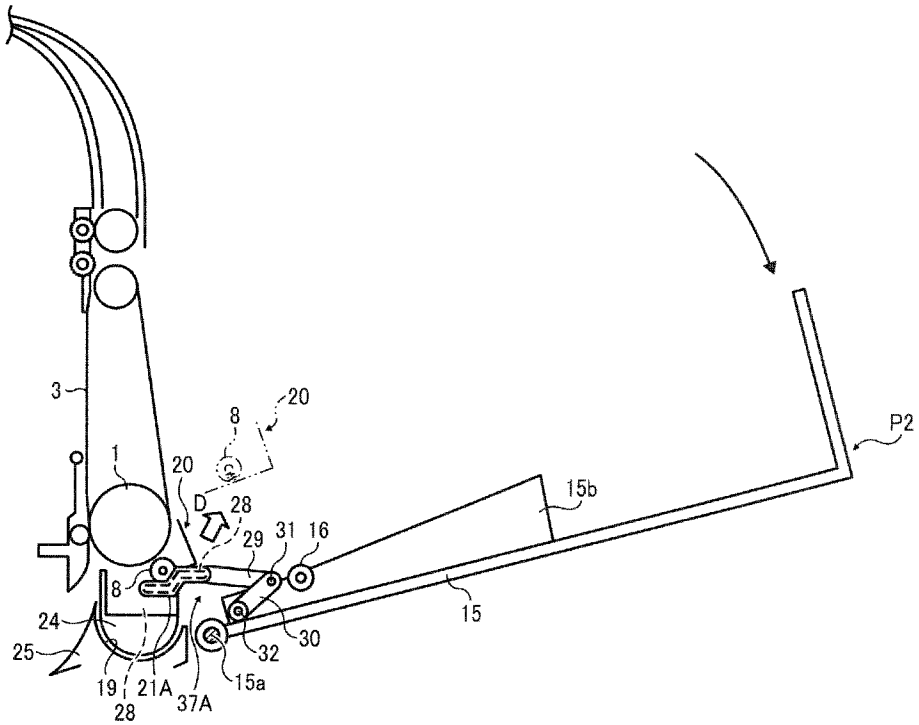
FIG. 7C is a schematic partial cross-sectional front view of an operation state of the charging unit and the slider crank mechanism in the variation 1 in a state where the openable cover is at a second open position.
Figure 8A:
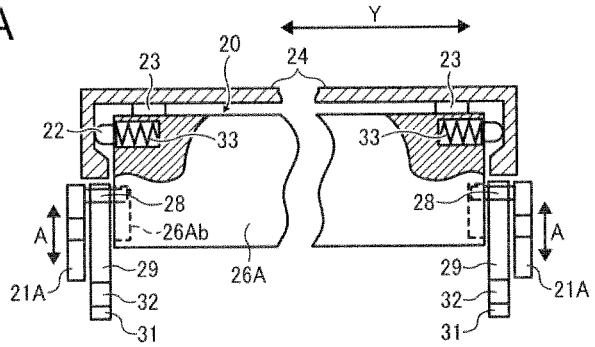
FIG. 8A is a schematic partial cross-sectional plan view of an operation state of the charging unit and the slider crank mechanism in the variation 1 in a state where the openable cover is at the closed position.
Figure 8B:
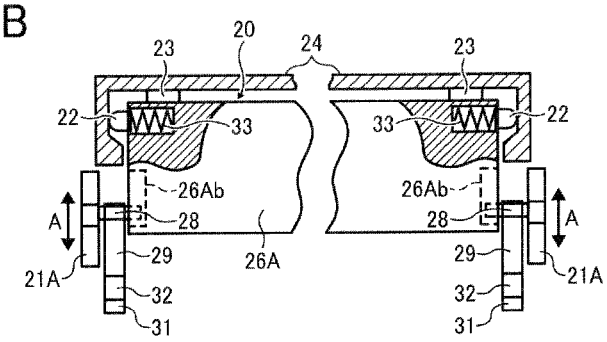
FIG. 8B is a schematic partial cross-sectional plan view of an operation state of the charging unit and the slider crank mechanism in the variation 1 in a state where the openable cover is at the first open position.
Figure 8C:
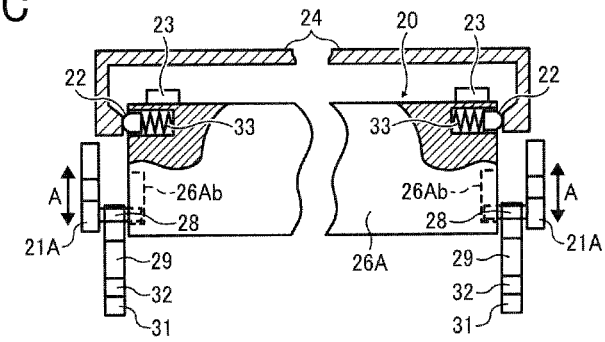
FIG. 8C is a schematic partial cross-sectional plan view of an operation state of the charging unit and the slider crank mechanism in the variation 1 in a state where the openable cover is at the second open position.
Figure 9:
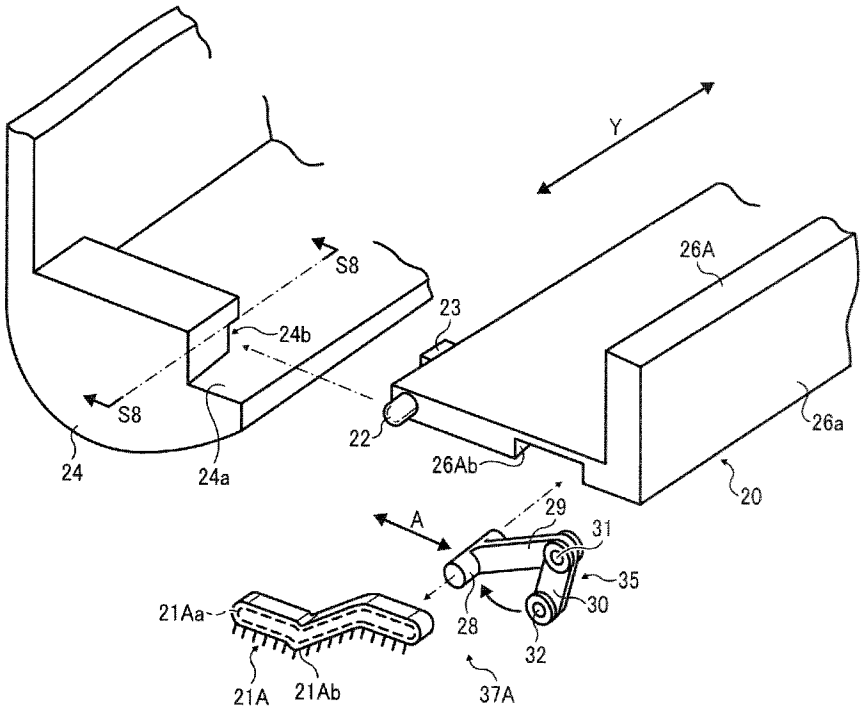
FIG. 9 is a partially exploded perspective view of the charging unit and the slider crank mechanism in the variation 1.

FIG. 7A is a schematic view of the charging unit and the slider crank mechanism in the variation 1 in a state where the openable cover is at a closed position. FIG. 7B is a schematic view of the charging unit and the slider crank mechanism in the variation 1 in a state where the openable cover is at a first open position. FIG. 7C is a schematic view of the charging unit and the slider crank mechanism in the variation 1 in a state where the openable cover is at a second open position. FIG. 8A is a schematic view of an operation state of the charging unit and the slider crank mechanism in the variation 1. FIG. 8B is a schematic view of an operation state of the charging unit in the variation 1 and the slider crank mechanism in a state where the openable cover is at the first open position. FIG. 8C is a schematic view of an operation state of the charging unit and the slider crank mechanism in the variation 1 in a state where the openable cover is at the second open position. FIG. 9 is a partially exploded perspective view of the charging unit and the slider crank mechanism in the variation 1. FIGS. 8A to 8C show a cross sectional plane of an inner guide member 24 cut along a line S8-S8 in FIG. 9.

The variation 1 of the first exemplary embodiment differs from the first exemplary embodiment illustrated in FIGS. 3 to 6 mainly in the following points. First, the variation 1 employs a unit housing 26A illustrated in, e.g., FIG. 9 instead of the unit housing 26 of the first exemplary embodiment. The variation 1 also employs a configuration in which, as illustrated in FIG. 7, the openable cover 15 is pivotable among the closed position, a first open position P1, and a second open position P2 for opening and closing, instead of the configuration in which the openable cover 15 is pivotable between the closed position and the open position for opening and closing. In addition, the variation 1 employs a slider crank mechanism 37A serving as a unit-interlocked moving device illustrated in FIGS. 7 to 9 instead of the slider crank mechanism 37 of the first exemplary embodiment. The configuration of the variation 1 is substantially the same as the configuration of the first exemplary embodiment except for the above-described differences.

Below, the configuration of the variation 2 is described while focusing on the above-described differences.

The unit housing 26A differs from the unit housing 26 in that, as illustrated in FIG. 9, the unit housing 26A has a slider engagement portion 26Ab longer than the slider engagement portion 26*b* of the unit housing 26 in a direction indicated by an arrow A. An extended length of the slider engagement portion 26Ab is utilized to prevent the charging unit 20 from sliding toward the outside of the reverse passage 19 when the openable cover 15 pivots to open from the closed position illustrated in FIG. 7A to the first open position P1 illustrated in FIG. 7B.

In the variation 1, the openable cover 15 can also pivot between the first open position P1 and the second open position P2 for opening and closing. When the openable cover 15 is placed at the first open position P1, the reverse passage 19 and the duplex transport passage 57 are open to the outside. When the openable cover 15 is placed at the second open position P2, the charging unit 20 is removable from the body. It is to be noted that, at the second open position P2, the openable cover 15 may have an opening angle equal to or larger than that of the openable cover 15 at the open position in the first exemplary embodiment.

The slider crank mechanism 37A serves as the unit-interlocked moving device to open a part of the reverse passage 19 and the duplex transport passage 57 with a pivoting opening operation of the openable cover 15 from the closed position to the first open position P1, slide the charging unit 20 toward the outside of the reverse passage 19 with a pivoting opening operation of the openable cover 15 from the first open position P1 to the second open position P2, and move the charging unit 20 to the removable position at which the charging unit 20 is removable from the body when the openable cover 15 is placed at the second open position P2. The slider crank mechanism 37A differs from the slider crank mechanism 37 of the first exemplary embodiment in that, instead of the slider guide member 21 having the bottomed groove 21*a*, the slider crank mechanism 37A employs a slider guide member 21A having a bottomed groove 21Aa longer than the bottomed groove 21*a* in the direction indicated by the arrow A in FIG. 9. The slider crank mechanism 37A has the same link unit 35 as that of the first exemplary embodiment. The slider guide member 21A are fixed at the body at a position adjacent to each end of the reverse passage 19 in a sheet width direction indicated by an arrow Y in FIG. 9.

The slider guide member 21A has the bottomed groove 21Aa and a recessed holding portion 21Ab. The bottomed groove 21Aa has a bent portion, and a slider 28 of the link unit 35 slidably engages the bottomed groove 21Aa. The holding portion 21Ab temporarily holds the openable cover 15 by applying a friction resistance force to the slider 28. A charging unit 20 is slidable along a length of the bottomed groove 21Aa in the direction indicated by the arrow A in FIG. 9. Such temporary holding of the slider 28 at the holding portion 21Ab allows the openable cover 15 to be temporarily placed at the first open position P1.

Next, operation of the slider crank mechanism 37A with opening and closing of the openable cover 15 is described below.

In FIG. 7A, when the openable cover 15 is placed at the closed position, a first end of the slider 28 molded with an end of a link 29 is placed at a first end (left end in FIG. 9) of the bottomed groove 21Aa of the slider guide member 21A proximal to the inner guide member 24. Simultaneously, a second end of the slider 28 opposite the first end engages a wall face (left-side wall face in FIG. 9) of the slider engagement portion 26Ab of the unit housing 26A proximal to the inner guide member 24. As a result, the charging unit 20 is pressed by the link unit 35 toward the mount position to take the mount position. Thus, when the openable cover 15 is placed at the closed position, the charging unit 20 cannot be slid for replacement or other operation.

As illustrated in FIG. 8A, when the openable cover 15 is placed at the closed position, projections 23 projecting from a wall face (upper wall face in FIG. 8A) of the unit housing 26A contact an inner wall face of the inner guide member 24. Simultaneously, bosses 22 urged by springs 33 in the unit housing 26A are pressed against second boss guide faces 24*b* at opposed ends of the inner guide member 24, thus assisting to prevent the charging unit 20 from sliding toward the openable cover 15. When the openable cover 15 is placed at the closed position, finally, the slider crank mechanism 37A serves as a pressing unit to prevent the charging unit 20 from moving to the removable position.

As illustrated in FIG. 7B, with a pivoting opening operation of the openable cover 15 toward the first open position P1, the slider 28 molded with the end of the link 29 slides toward a second end (right end in FIG. 7*b*) of the bottomed groove 21Aa proximal to the openable cover 15 and engages the holding portion 21Ab. Thus, the slider 28 is temporarily held at the holding portion 21Ab. At this time, as illustrated in FIG. 8B, the second end of each slider 28 is only inserted to the slider engagement portion 26Ab of the unit housing 26A having a width greater than the slider engagement portion 26*b* but is not engaged with an inner wall of an end portion of the slider engagement portion 26Ab. As a result, since a force for sliding the charging unit 20 is not transmitted, only the slider 28 slides toward the second end (right end in FIG. 9) of the bottomed groove 21Aa and an end of the slider engagement portion 26Ab proximal to the openable cover 15. Thus, when the openable cover 15 is placed at the first open position P1, the charging unit 20 is placed at the same position as that of FIG. 8A.

As illustrated in FIGS. 7B and 7C, when the openable cover 15 is further opened from the first open position P1 to the second open position P2, with the pivoting opening operation, the first end of the slider 28 molded with the second end of the link 29 further slides to the second end (right end in FIG. 9) of the bottomed groove 21Aa of the slider guide member 21A proximal to the openable cover 15. Simultaneously, through engagement of the second end of the slider 28 with an inner wall (right-side inner wall in FIG. 9) of the slider engagement portion 26Ab of the unit housing 26A proximal to the openable cover 15, the charging unit 20 slides on a bottom wall face of the inner guide member 24 to the right side of FIG. 7B (toward the openable cover 15). As a result, the charging unit 20 takes the removable position at which the charging unit 20 can be drawn for replacement in a direction indicated by an arrow D in FIG. 7C.

As described above, when the openable cover 15 is placed at the second open position P2, the variation 1 gives effects equivalent to those of the first exemplary embodiment. In addition, even when the openable cover 15 is open to the first open position P1, the variation 1 prevents an operator from contacting the charging unit 20 applied with high voltage, thus securing operator's safety.

Variation 2 of First Exemplary Embodiment

Another variation 2 of the variation 1 illustrated in FIGS. 7 to 9 is described with reference to FIG. 10.

Figure 10:
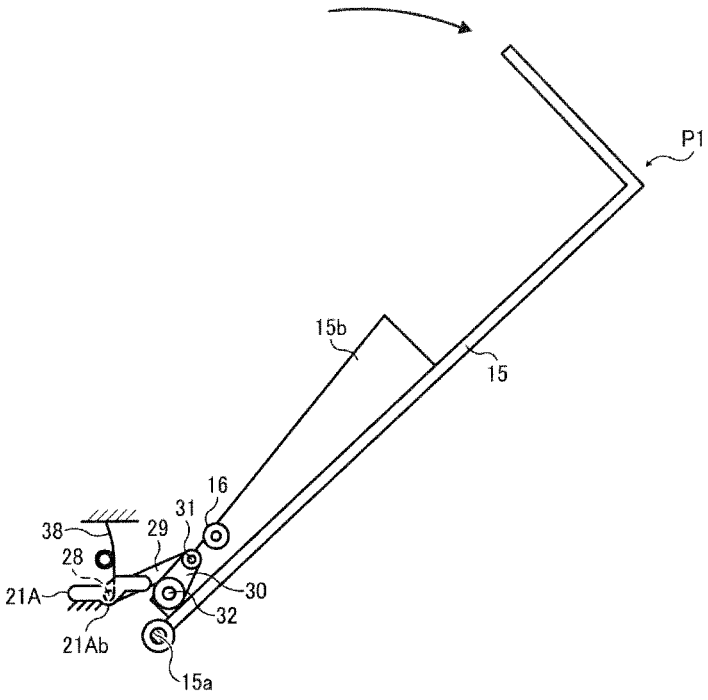
FIG. 10 is a schematic partial cross-sectional front view of an urging member to hold an openable cover at a first open position in a variation 2 of the first exemplary embodiment.

FIG. 10 is a schematic view of an urging member to hold an openable cover at a first open position. The variation 2 differs from the variation 1 illustrated in FIGS. 7 to 9 in that a charging unit 20 has a twisted coil spring 38 serving as an urging member to urge a slider 28 of a slider crank mechanism 37A in such a direction as to prevent the charging unit 20 from moving to the outside of a reverse passage 19 when an openable cover 15 is placed at a first open position P1. The configuration of the variation 2 is substantially the same as the configuration of the variation 1 except for the above-described difference. Below, the configuration of the variation 2 is described while focusing on the above-described differences.

The twisted coil spring 38 has an end engaging the slider 28 of the slider crank mechanism 37A and the opposite end engaging a stationary member of the body. When the openable cover 15 is placed at the first open position P1, the slider 28 engages a recessed holding portion 21Ab at a middle portion of a bottomed groove 21Aa of a slider guide member 21A. The twisted coil spring 38 elastically urges the slider 28 engaging the holding portion 21Ab in such a direction as to prevent the charging unit 20 from moving to the outside of the reverse passage 19. Thus, the openable cover 15 and the charging unit become immovable. It is to be noted that the urging member is not limited to the twisted coil spring 38 but may be, for example, a leaf spring, an extension spring, or any other suitable elastic member.

As described above, the variation 2 gives effects equivalent to those of the variation 1. In addition, when the openable cover 15 is placed at the first open position P1, the slider 28 of the slider crank mechanism 37A is urged in such a direction as to prevent the charging unit 20 from moving to the outside of the reverse passage 19. As a result, the openable cover 15 is temporarily held at the first open position P1 in a more reliable manner to allow an operator to remove a jammed sheet at the duplex transport passage 57. Thus, the configuration of the variation 2 allows replacement, servicing/maintenance, and cleaning of the charging unit 20 without reducing the ease of removal of a jammed sheet.

Although the first exemplary embodiment and its variations are described above, it is to be noted that the art disclosed in the present disclosure is not limited to the above-described exemplary embodiment and its variations but, for example, the above-described exemplary embodiment and its variations may be appropriately combined. It is will be obvious for one of ordinal skill in the art that, in light of the above teachings, different exemplary embodiments and variations are possible according to need and use.

For example, the image forming apparatus recited in appended claims is not limited to the above-described inkjet recording apparatus 100 but may be an image forming apparatus including an inkjet recording device in, for example, a printer, a plotter, a word processor, a facsimile machine, a copier, or a multi-functional device having two or more of the foregoing capabilities. In addition, the image forming apparatus recited in appended claims is not limited to the serial-type inkjet recording apparatus 100 but may be a line-head-type inkjet recording apparatus employing a conveyance belt to convey a sheet while adhering the sheet thereon. Additionally, sheets are not limited to the sheets P but may be thin sheets, thick sheets, postcards, envelopes, OHP sheets, or any other type of sheets on which images can be formed by an inkjet recording method. In the above-described exemplary embodiment and variations, the charging unit is described as an example of a replaceable unit. It is to be noted that the replaceable unit is not limited to the charging unit but may be any other suitable type of replaceable unit.

In the above-described exemplary embodiment and variations, the following configurations are employed.

In other words, in the above-described exemplary embodiment and variations, an image forming apparatus has a body, a conveyance belt looped around at least two rotation members for circulation to convey a sheet of recording media, an image forming device disposed opposing the conveyance belt to form images on the sheet at a first side of the conveyance belt opposing the image forming device, a refeeding unit arranged to switch back the sheet having an image formed on a first face of the sheet and refeed and guide the sheet to the surface of the conveyance belt at a second side of the conveyance belt not opposing the image forming device, a reverse passage arranged to, after the sheet refed from the refeeding unit passes the surface of the conveyance belt at the second side, guide the sheet again to the surface of the conveyance belt at the first side of the conveyance belt opposing the image forming device while turning around the sheet and bypassing an outer circumferential part of the conveyance belt looped around the at least two rotation members, a charging unit forming part of the reverse passage and including a charger to charge the conveyance belt, the charger disposed between an inner side of the reverse passage and one of the at least two rotation members upstream in a direction in which the sheet is conveyed with the conveyance belt at the first side, an openable cover pivotable between a closed position to cover an internal area of the body including at least the charger and the reverse passage and an open position to open the internal area to an outside of the body, and a unit-interlocked moving device to, with a pivoting movement of the openable cover from the closed position to the open position, move the charging unit toward an outside of the reverse passage to a removable position at which the charging unit is removable from the body with the openable cover placed at the open position.

In the image forming apparatus, the open position may include a first open position and a second open position. The openable cover is pivotable between the first open position and the second open position. When the openable cover is placed at the first open position, a refeed passage from the refeeding unit and the reverse passage are open to the outside of the body. When the openable cover is placed at the second open position, the charging unit is removable from the body. With a pivoting movement of the openable cover from the first open position to the second open position, the unit-interlocked moving device causes the charging unit to move to the removable position. Alternatively, the image forming apparatus may include a pressing unit to press the charging unit in such a direction as to prevent the charging unit from moving to the removable position when the openable cover is placed at the closed position or the first open position. The image forming apparatus may further includes an urging member to urge the unit-interlocked moving device in such a direction as to prevent the charging unit from moving to the outside of the reverse passage when the openable cover is placed at the first open position.

What is claimed is:

1. An image forming apparatus comprising:

a body;

a conveyance belt looped around at least two rotation members for circulation to convey a sheet of recording media in a vertical direction;

an image forming device disposed opposing the conveyance belt to form images on the sheet at a first side of the conveyance belt opposing the image forming device;

a guide disposed below the conveyance belt to guide the sheet to the first side of the conveyance belt;

a charging unit including a charger to charge the conveyance belt, the charger being disposed inside the guide and upstream in a direction in which the sheet is conveyed by the first side of the conveyance belt;

an openable cover pivotable between a closed position to cover an internal area of the body including the charger and an open position to open the internal area to an outside of the body; and a unit-interlocked moving device to, with a pivoting movement of the openable cover from the closed position to the open position, move the charging unit toward a removable position at which the charging unit is removable from the body with the openable cover placed at the open position, wherein the unit-interlocked moving device is disposed at each end of the guide in a width direction of the sheet passing the guide, wherein the unit-interlocked moving device has a slider guide member fixed at the body at a position adjacent to the each end of the guide and a link unit disposed between the slider guide member and the charging unit to link the slider guide member and the charging unit, wherein the slider guide member has a groove formed along a horizontal and longitudinal direction of the slider guide member and the link unit has a slider slidably engaging the groove of the slider guide member and the charging unit, and wherein with the pivoting movement of the openable cover from the closed position to the open position, the charging unit slides horizontally along a length of the groove of the slider guide member.

2. The image forming apparatus of claim 1, further comprising a pressing unit to press the charging unit in such a direction as to prevent the charging unit from moving to the removable position when the openable cover is placed at the closed position.

3. The image forming apparatus of claim 1, wherein the open position includes a first open position and a second open position, the openable cover is pivotable between the first open position and the second open position, when the openable cover is placed at the first open position, the guide is open to the outside of the body, when the openable cover is placed at the second open position, the charging unit is removable from the body, and with a pivoting movement of the openable cover from the first open position to the second open position, the unit-interlocked moving device causes the charging unit to move to the removable position.

4. The image forming apparatus of claim 3, further comprising a pressing unit to press the charging unit in such a direction as to prevent the charging unit from moving to the removable position when the openable cover is placed at the closed position or the first open position.

5. The image forming apparatus of claim 3, further comprising an urging member to urge the unit-interlocked moving device in such a direction as to prevent the charger from moving to the outside of the guide when the openable cover is placed at the first open position.

* * * * *